US005654530A

United States Patent [19]

Sauer et al.

[11] Patent Number: 5,654,530

[45] Date of Patent: Aug. 5, 1997

[54] AUDITORY CANAL INSERT FOR HEARING AIDS

[75] Inventors: Joseph Sauer, Strullendorf; Christof Haertl, Neunkirchen, both of Germany

[73] Assignee: Siemens Audiologische Technik GmbH, Erlangen, Germany

[21] Appl. No.: 575,597

[22] Filed: Dec. 20, 1995

[30] Foreign Application Priority Data

Feb. 10, 1995 [DE] Germany ..... 19504478.9

[51] Int. Cl.[6] ..... H04R 25/02

[52] U.S. Cl. ..... 181/130; 181/135

[58] Field of Search ..... 181/129, 130, 181/135; 381/68.6, 69; 128/864, 865, 867

[56] References Cited

U.S. PATENT DOCUMENTS

| | | | |
|---|---|---|---|
| 789,876 | 5/1905 | Pape | 181/135 |
| 1,830,198 | 11/1931 | French | 181/135 |
| 2,521,414 | 9/1950 | Schier | 181/135 |
| 2,535,258 | 12/1950 | Bland | 181/135 |
| 2,908,343 | 10/1959 | Hummert | 181/135 |
| 4,869,339 | 9/1989 | Barton | 181/135 X |
| 5,002,151 | 3/1991 | Oliveira et al. | 181/130 |

FOREIGN PATENT DOCUMENTS

| | | |
|---|---|---|
| 17 79 936 | 10/1959 | Germany . |
| 12 31 304 | 12/1966 | Germany . |
| 79 29 224 | 3/1981 | Germany . |
| 79 29 226 | 3/1981 | Germany . |

*Primary Examiner*—Khanh Dang
*Attorney, Agent, or Firm*—Hill, Steadman & Simpson

[57] ABSTRACT

For retention and sound-damping sealing of members introducible into the auditory canal, such as hearing aid housings, otoplastics or ear adapters, an annularly fashioned seal and retainer element can be plugged onto the member and when the member is inserted into the auditory canal, the retainer element fits itself against the walls of the auditory canal and seals the annular gap between the outside contour of the member and the auditory canal in sound-damping fashion.

9 Claims, 2 Drawing Sheets

AUDITORY CANAL INSERT FOR HEARING AIDS

BACKGROUND OF THE INVENTION

1. Field of the Invention

The invention is directed to an auditory canal insert for hearing aids of the type composed of a member introducible into the outer auditory canal with an acoustic channel to the tympanic membrane and having means for positioning the member in and sealing the member from the auditory canal. A seal ring of soft elastic material which fits against the walls of the auditory canal can be plugged into a retainer groove of the member and seals the annular gap between the outside contour of the member and the auditory canal in a sound-damping fashion. The invention is also directed to a seal and retainer element for in-the-ear hearing aids introducible into the auditory canal.

2. Description of the Prior Art

Otoplastics and customized ear adapters are especially employed when matching a hearing aid to the shape of the auditory canal of the ear of a hearing-impaired person. Such otoplastics and ear adapters function, first, for firmly positioning the hearing aid, so that the hearing aid cannot slip or fall out of the ear. Further, the otoplastic or ear adapter has a sound-damping effect in order to prevent feedback between the microphone and the earphone of the hearing aid. Otoplastics usually serve as an adapter for in-the-ear hearing aids (ItE aids), in contrast to ear adapters, which are suitable for behind-the-ear hearing aids (BtE aids).

In the standard manufacturing method of otoplastics and customized ear adapters, an impression of the auditory canal of the ear of the acoustically impaired person who is to wear the hearing aid is first made. Thereafter, a negative is shaped with the impression. Only then can an otoplastic or an ear adapter that is matched in shape to the auditory canal of the ear be produced therefrom. Frequently, the otoplastic or the ear adapter must still be trimmed or ground after manufacture in order to eliminate casting errors. Since this procedure is expensive and time-consuming, manufacturers have long attempted to develop a method with which the production of an impression and the production of a negative can be avoided.

For example, German AS 12 31 304 discloses a method wherein a self-hardening plastic is distributed on a base member that simulates the basic shape of the auditory canal of the human ear and the coated base member is subsequently inserted directly into the auditory canal of the hearing-impaired person until the plastic, which has now adapted to the inside counter of the auditory canal, has hardened. The matching to the inside contour, however, is not always optimum. As a result of pressing the basic form coated with plastic into the ear, there is the risk of pressing plastic too far into the auditory canal. In this method, moreover, a multitude of different, standard base members is required, since the plastic coating is insufficient for adequately adapting to shapes of auditory canal given employment of a uniform base member.

Formed parts of foamed material have been recently developed for ear adapters. Such formed parts of foamed material have been known for a long time as anti-noise plugs and are mass produced. A matching to individual auditory canals is not implemented. The parts of foamed material are merely compressed and plugged into the ear, where they subsequently expand to conform to the surrounding shape. 3M, is a manufacturer of such foam plugs (see, for example, the article "Disposable foam earmolds" by Smolak et al., in Hearing Instruments, volume 38, No. 12, 1987). Such foams, however, are less suited as a pure otoplastic replacement for an in-the-ear hearing aid since the foamed material is too soft. Moreover, such porous foamed materials are quickly contaminated by cerumen, etc., and must be replaced frequently. Such foams are also not optimum as ear adapters.

German Utility Model 1 779 936 discloses an ear adapter for connection to an earphone or to a sound conduit of a hearing aid. This adapter is shaped of a comparatively solid, malleable-elastic main member of plastic or rubber such that it presses against the walls of the auditory canal over its entire circumference in at least portions thereof. The main member is tapered at its end facing toward the inside of the ear and is provided with a retainer groove and following cone, whereby a seal ring that likewise presses against the walls of the auditory canal at its circumference and is composed of a softer, likewise malleable-elastic material is seated on the retainer groove and the cone. The main member and the seal ring are expediently plugged onto one another and can be easily separated from one another. Given this ear adapter as well as the similarly fashioned ear adapters of German Utility Models 79 29 224 and 79 29 226, standard base members of different sizes are required dependent on the size of the auditory canal and the wearing comfort is diminished because of the pressure of the adapter against the wall of the auditory canal.

SUMMARY OF THE INVENTION

An object of the invention is to provide a simply constructed auditory canal insert with improved wearing comfort.

In an auditory canal insert for hearing aids of the type initially described, this object is inventively achieved by employing a seal ring composed of an annular disk-shaped seal and retainer element that is slotted at its outside circumference, such that the circumferential segments of the seal and retainer element formed by the slots fit themselves against the walls of the auditory canal fan-like or lamella-like.

This object is also achieved in accordance with the principles of the present invention in a seal and retainer element for in-the-ear hearing aids introducible into the auditory canal, having at least two annular disk-shaped elements of elastic material having different inside and/or outside diameters slipped onto the hearing aid housing and introducible into the auditory canal together with the hearing aid housing. The seal and retainer elements form the seal of the hearing aid housing vis-a-vis the auditory canal as well as the retainer of the hearing aid housing in the auditory canal.

The inventive seal and retainer element can be very simply manufactured in different wafer thicknesses and/or with different inside and/or outside diameters. Accordingly, this seal and retainer element is extremely well-suited for matching to the individual auditory canal sizes in that it can be plugged onto housings of hearing aids insertable into the auditory canal or onto standardized otoplastics or onto standardized ear adapters. Since the seal and retainer element can be manufactured of sweat-resistant material, the element can be regularly cleaned and the re-used. Compared to known, porous foam ear adapters, the inventive seal and retainer element is a more durable solution. Especially good wearing comfort is achieved because the seal and retainer element is fashioned slotted in its outside circumference. Given this fashioning, the seal and retainer element can adapt fold-free in the auditory canal to the walls of the auditory canal, or can fix itself thereagainst fan-like or lamella-like without building up substantial pressure to deteriorate the wearing comfort.

DESCRIPTION OF THE PREFERRED EMBODIMENTS

Figure 1:
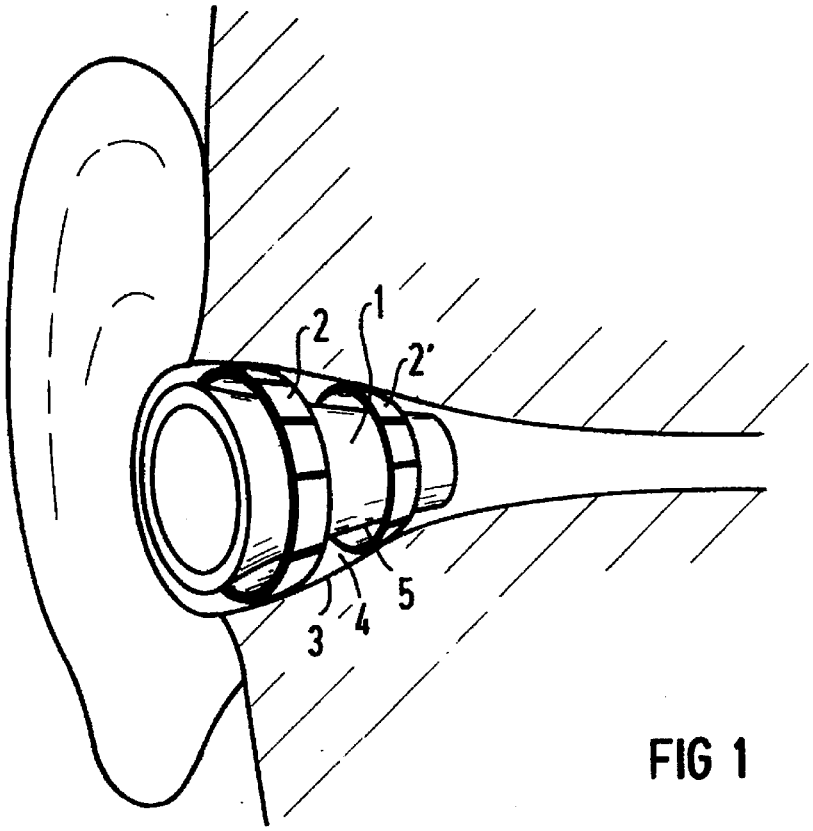
FIG. 1 shows an in-the-ear (ITE) hearing aid having two seal and retainer elements constructed in accordance with the principles of the present invention, inserted into the auditory canal.

FIG. 1 shows a member 1 to be worn in the outer auditory canal, namely a hearing aid housing of an ItE hearing aid, having two seal and retainer elements 2,2' plugged on spaced that seal the annular gap 4 between the outside contour 5 of the hearing aid housing and the walls 3 of the auditory canal in sound-damping fashion and hold the hearing aid 1 in the auditory canal.

Figure 2:
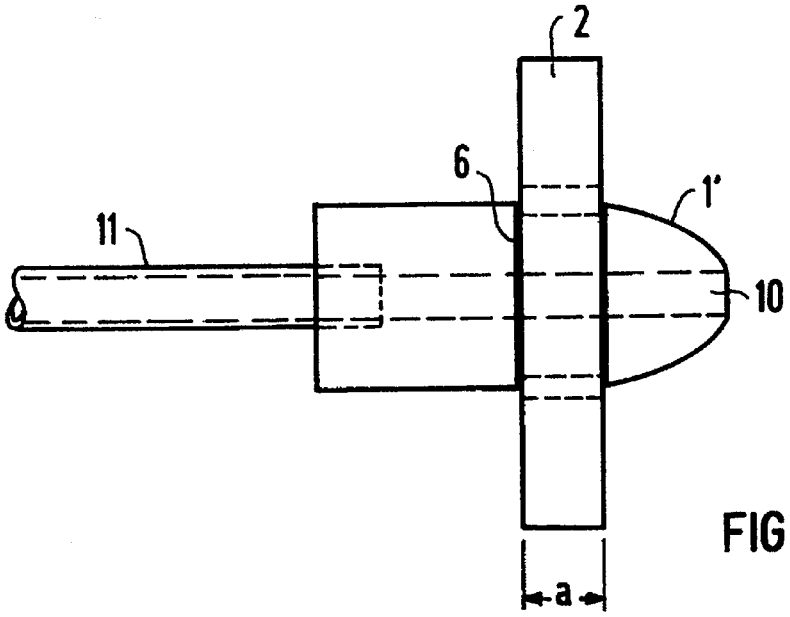
FIG. 2 is a side view of an ear adaptor constructed in accordance with the principles of the present invention, introducible into the outer auditory canal.

FIG. 2 shows an ear adapter 1' introducible into the outer auditory canal that is connected to a sound output conduit 11 of a BtE hearing aid and which has a sound channel 10 extending therethrough to the tympanic membrane. An annular disk-shaped seal and retainer element 2 is plugged onto the ear adapter 1' for retention in the auditory canal and for sealing in the auditory canal.

Figure 3:
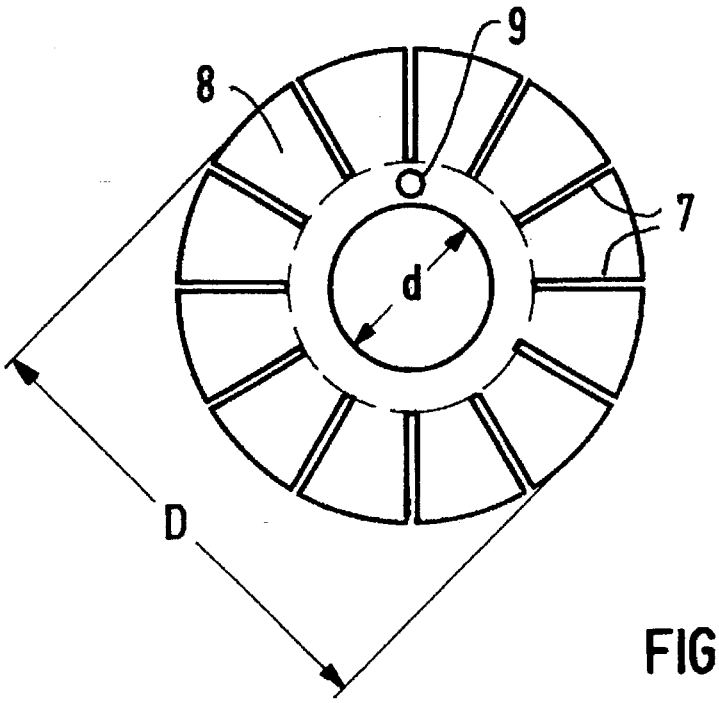
FIG. 3 is a plan view of a single, annular seal and retainer element constructed in accordance with the principles of the present invention.
Figure 4:
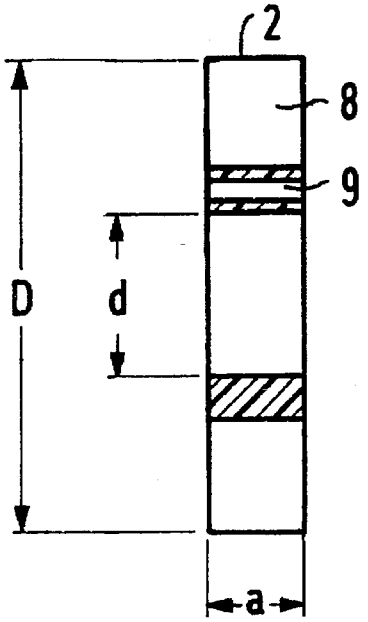
FIG. 4 is a section taken through the seal and retainer element of FIG. 3.

FIG. 3 shows a plan view of an annular disk-shaped seal and retainer element 2 that has approximately radially proceeding slots 7 in its outer circumferential region 8 with at least one vent opening 9 is provided in the seal and retainer element. FIG. 4 is a section through the seal and retainer element.

The seal and retainer elements 2 and 2' can be implemented with different disk thicknesses a or with different inside diameters d or different outside diameters D. The elements 2 and 2' can be composed of elastic plastic, for example a silicone or elastomer. A retainer 6 is provided for fixing one or more seal and retainer elements to a member pluggable into the auditory canal, for example to an ItE hearing aid housing 1 or to an otoplastic or to an ear adapter 1'. As such a retainer 6, the member 1 or 1' can have annular channels, beads, annular rolls or the like on its exterior surface. As a result of the elastic fashioning of the annular disk-shaped seal and retainer elements 2 and 2', these simple retainers 6 usually suffice for fixing the elements 2 and 2' at the member 1 and 1'. If necessary, the seal and retainer element 2 or 2' can also be glued to the member 1 or 1'. In FIGS. 2 and 4, the seal and retainer element 2—which is not drawn to scale—is shown with a disk wall thickness a that is implemented significantly thinner in the actual embodiment given an element 2 of elastic plastic because of the desired elasticity of the lamellae 8 and for pleasant wearing comfort.

Although modifications and changes may be suggested by those skilled in the art, it is the intention of the inventors to embody within the patent warranted hereon all changes and modifications as reasonably and properly come within the scope of their contribution to the art.

We claim as our invention:

1. A sealing and mounting element for an in-the-ear hearing aid adapted for insertion into an outer auditory canal leading to an inner ear of a wearer of the hearing aid, said hearing aid having an acoustic channel therein for acoustic communication between the outer auditory canal and a tympanic membrane in the inner ear, there being an annular gap between an outside surface of said element and a wall of the outer auditory canal, said sealing and mounting element comprising:

a member having an annular retainer groove therein; and a positioning and seal ring disposed in said retainer groove consisting of a disk of soft elastic material having a slotted outer circumference divided into a plurality of fan-like circumferential segments fittable against and adapted to a shape of said wall of said outer auditory canal and said segments together forming means for sound-damping and for positioning and for sealing said member in said auditory canal.

2. The element of claim 1 wherein said member has a plurality of annular retainer grooves and a plurality of positioning and seat rings respectively disposed in said grooves, each ring having said plurality of fan-like circumferential segments.

3. The element of claim 2 wherein each of said rings has an inside diameter with each inside diameter being different.

4. The element of claim 2 wherein each of said rings has an outside diameter with each outside diameter being different.

5. The element of claim 2 wherein each of said rings has a thickness with each thickness being different.

6. The element of claim 1 wherein said slotted outer circumference of said ring comprises a plurality of radially proceeding slots.

7. The element of claim 1 wherein said ring comprises a recess therein forming a vent opening.

8. An in-the-ear hearing aid having a hearing aid portion adapted for insertion into an auditory canal and having at least two annular, circumferentially slotted disk-shaped elements of elastic material, each disk-shaped element having an inside diameter and said inside diameters being different, said disk-shaped elements each surrounding said portion of said hearing aid adapted for insertion into the auditory canal and being adapted for insertion into the auditory canal together with said portion, said disk-shaped elements together forming means for sound-damping and for positioning and for sealing said portion of said hearing aid in said auditory canal.

9. An in-the-ear hearing aid having a hearing aid portion adapted for insertion into an auditory canal and having at least two annular, circumferentially slotted disk-shaped elements of elastic material, each disk-shaped element having an outside diameter and said outside diameters being different, said disk-shaped elements each surrounding said portion of said hearing aid adapted for insertion into the auditory canal and being adapted for insertion into the auditory canal together with said portion, said disk-shaped elements together forming means for sound-damping and for positioning and for sealing said portion of said hearing aid in said auditory canal.

* * * * *